US005190598A

United States Patent [19]

Qureshi

[11] Patent Number: 5,190,598

[45] Date of Patent: Mar. 2, 1993

[54] STEAM TURBINE COMPONENTS HAVING DUPLEX COATINGS FOR IMPROVED EROSION RESISTANCE

[75] Inventor: Javaid I. Qureshi, Winter Springs, Fla.

[73] Assignee: Westinghouse Electric Corp., Pittsburgh, Pa.

[21] Appl. No.: 867,996

[22] Filed: Apr. 13, 1992

Related U.S. Application Data

[62] Division of Ser. No. 484,317, Feb. 26, 1990.

[51] Int. Cl.[5] ..... B05D 3/10; C23C 8/70

[52] U.S. Cl. ..... 148/217; 148/220; 148/525; 148/529; 427/249; 427/580; 427/586

[58] Field of Search ..... 148/217, 220, 525, 529; 427/37, 49, 53.1, 249

[56] References Cited

U.S. PATENT DOCUMENTS

| | | | |
|---|---|---|---|
| 3,286,684 | 11/1966 | Aves | 118/48 |
| 3,662,402 | 11/1971 | Baranow et al. | 148/6.35 |
| 3,824,134 | 7/1974 | Chance | 148/6 |
| 3,935,034 | 1/1976 | Hayes | 148/6 |
| 3,951,612 | 4/1976 | Gates et al. | 29/195 |
| 3,958,047 | 5/1976 | Baldi | 427/252 |
| 4,024,294 | 5/1977 | Rairden, III | 427/42 |
| 4,040,870 | 8/1977 | Holzl | 427/249 |
| 4,066,806 | 1/1978 | Speirs et al. | 427/253 |
| 4,117,179 | 9/1978 | Jackson et al. | 427/405 |
| 4,145,481 | 3/1979 | Gupta et al. | 428/678 |
| 4,371,570 | 2/1983 | Goebel et al. | 427/248.1 |
| 4,411,960 | 10/1983 | Mizuhara | 428/610 |
| 4,485,148 | 11/1984 | Rashid et al. | 428/610 |
| 4,537,793 | 8/1985 | Kehrer et al. | 427/49 |
| 4,806,175 | 2/1989 | Wendt | 148/217 |
| 4,895,770 | 1/1990 | Schintlmeister et al. | 428/552 |

FOREIGN PATENT DOCUMENTS

| | | | |
|---|---|---|---|
| 52-70943 | 6/1977 | Japan . | |
| 62-127459 | 6/1987 | Japan | 148/217 |

OTHER PUBLICATIONS

Abstract of G. V. Zemiskov, et al., "Surface Alloying of Boronized Steel," Izv. Vyssh. Uchebn. Zaved., Chern. Metall., (9), 132–5.

J. I. Qureshi, et al., "The Influence of Coating Processes and Process Parameters on Surface Erosion Resistance and Substrate Fatigue Strength," Surface and Coatings Technology, 36 (1988) 433–444.

J. Qureshi, et al., "Characterization of Coating Processes and Coatings for Stream Turbine Blades," Journal of Vacuum Science & Technology A, Second Series, vol. 4, No. 6 Nov./Dec. 1986, pp. 2638–2647.

*Primary Examiner*—George Wyszomierski

[57] ABSTRACT

The steam turbine components having erosion resistant multiple treatments are disclosed. The components include a ferrous substrate having an integral boride layer which typically reduces the underlying fatigue strength of the substrate and includes cracks or defects disposed therein. The boride layer is coated with a sealing layer to substantially cover the cracks or defects for improving the surface erosion resistance and restorings the substrate fatigue strength of the steam turbine component.

17 Claims, 1 Drawing Sheet

STEAM TURBINE COMPONENTS HAVING DUPLEX COATINGS FOR IMPROVED EROSION RESISTANCE

This is a division of application Ser. No. 484,371 filed Feb. 26, 1990.

FIELD OF THE INVENTION

This invention relates to coatings for improving the surface erosion resistance of steam turbine components, and particularly to multiple coating systems for providing improved overall properties.

BACKGROUND OF THE INVENTION

Electrical power generation employs turbine systems including components such as stationary and rotating blades, pipes and impellers, which are subject to the harsh erosive effects of hard particles present in steam and other high temperature gases. The in-service performance of these components is often governed by the mechanical properties of the substrate alloy, such as fatigue resistance, creep resistance, and tensile strength.

Preferred alloys used in manufacturing turbine components include high strength steels, low alloy steels, and stainless steels. Although exhibiting high strength, these materials are relatively prone to erosion and can be severely eroded when exposed to pressurized, high-temperature steam containing solid particles for extended periods of time. This erosion has been known to increase in severity until the component is no longer useful and must be replaced.

Accordingly, since the down-time associated with replacing components in a power turbine can run into hundreds of thousands of dollars, there is a pressing need for reducing erosion of steam turbine components.

One art-recognized procedure for minimizing the effects of erosion is to provide a relatively hard erosion-resistant surface, such as a boride coating, to the turbine component. See Hayes, U.S. Pat. No. 3,935,034 which is hereby incorporated by reference. Hayes discloses components treated with a pack cementation boride diffusion process in which the component is placed in a sealed box containing boron and an inert filler. The contents of the sealed box are then heated to a temperature of greater than about 1350° F. After being subjected to this temperature for a period of hours, the contents of the sealed box are cooled to room temperature. During this elevated temperature, the boron diffuses into the substrate steel of the component forming an boride coating consisting of iron boride and chromium boride intermetallic compounds on the steel substrate.

Studies have demonstrated that the erosion resistance of coated stainless steel test specimens including boride or carbide coatings is very dependent on the process parameters employed in depositing the coatings. See Qureshi, et al., "Characterization of Coating Processes and Coatings for Steam Turbine Blades", *Journal of Vacuum Science and Technology,* 2nd Series, Vol. 4, No. 6, p.p. 2638–2647 (Nov./Dec. 1986); Qureshi and Tabakoff, "The Influence of Coating Processes and Process Parameters on Surface Erosion Resistance and Substrate Fatigue Strength", *Surface and Coatings Technology,* 36, pp. 433–444 (1988).

While boride coatings provide an erosion resistant surface to steam turbine components, they often develop surface cracks and imperfections during required post coating heat treatment operations. These imperfections can seriously impair the fatigue strength of the steel substrate as well as the erosion life of the boride coating, thus minimizing the coating's potential as a protective surface. Moreover, boride coatings are known to oxidize at elevated service temperatures, resulting in spalling of the coating from the turbine component surfaces.

SUMMARY OF THE INVENTION

This invention provides power-generation steam turbine components and methods for their fabrication. The components include a synergistic combination of a ferrous substrate provided with an integral boride coating or layer containing a plurality of cracks or defects disposed therein. A sealing layer is provided on the boride layer to substantially cover the defects for improving both the surface erosion resistance and for substantially restoring the substrate fatigue strength of the overall steam turbine component. Accordingly, the synergistic combination of coatings is provided which substantially overcomes the known deficiencies of typically applied boride coatings, while preserving the erosion resistance of the underlying composite. The novel methods and structures provided herein disclose a method of preserving the underlying ductility and fatigue resistance of the.ferrous substrate of the turbine components.

In more detailed embodiments of this invention, hard materials such as chromium carbide or ceramic materials are chosen for the sealing layer for covering the defects of the boride coating. Such sealing layers are disposed in a thickness of less about 0.001 inches (0.025 mm). The methods described in the context of this invention further include specific pack cementation boride processes for preparing the boride layer, and selected vapor deposition processes for applying the sealing layers.

BRIEF DESCRIPTION OF THE DRAWINGS

The accompanying drawings illustrate preferred embodiments of the invention according to the practical application of the principles thereof, and in which.

DETAILED DESCRIPTION OF THE INVENTION

This invention provides improvements to coatings of steam and gas turbine components used for producing electrical power. Such components can be exposed to high pressure steam containing solid particles, gas, oil, industrial slurries, and other corrosive elements. The novel coating system of this invention increases the erosion resistance of the components without adversely effecting the fatigue strength of the underlying ferrous substrate. An additional benefit which is provided by this system is improved oxidation resistance of the turbine component, since defects in the boride layer are sealed and protected from the harsh environment.

In accordance with the principles of this invention, a steam turbine component is provided including a ferrous substrate having a first surface thereon and a boride layer disposed integrally with this first surface. The boride layer includes a plurality of cracks disposed therein, such as those typically created during post coating heat treatment. Disposed on the boride layer, is a sealing layer which substantially covers the plurality of cracks for improving the overall erosion resistance of the steam turbine component.

In a more detailed embodiment of this invention, a steam turbine component is provided having a substrate comprising stainless steel or a low alloy steel. Disposed integrally with this substrate is an boride layer having a plurality of surface defects and preferably including intermetallic compounds of iron boride and chromium boride. The application of this layer also creates a boride-containing diffusion layer in the substrate. Onto the surface of the boride layer of this embodiment is disposed a hard coating material, such as chromium carbide, having a thickness of less than about 0.001 inches 0.025 mm) for sealing, preferably entering, a portion of the plurality of surface defects for improving the erosion resistance of the steam turbine component.

Figure 1:
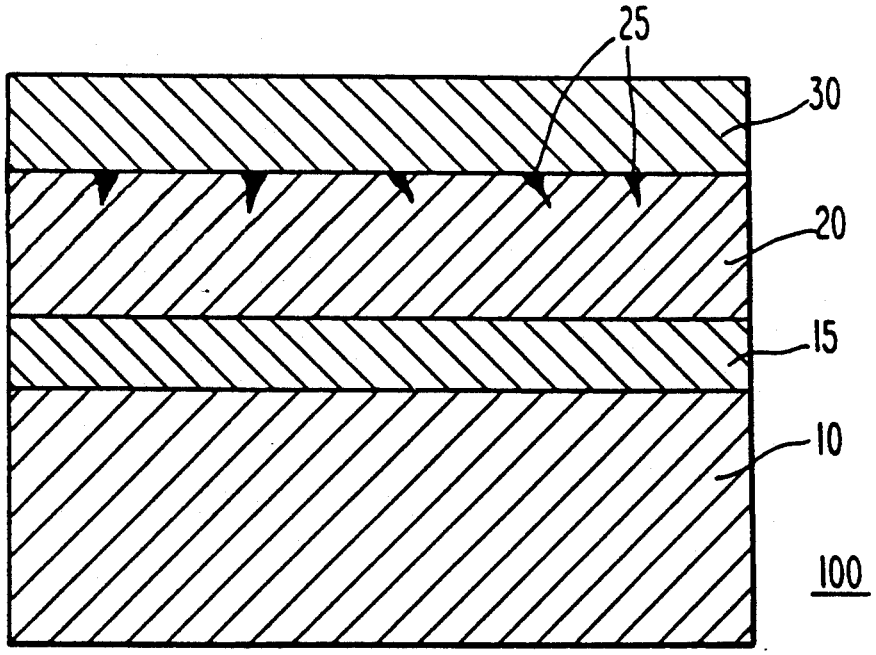
FIG. 1: is a diagrammatic, enlarged, cross-sectional view of the duplex coating of this invention.

With reference to the Figures, and particularly to FIG. 1, there is diagrammatically shown a cross-sectional view of a steam turbine component comprising a steel substrate 10. The substrate preferably includes a low alloy steel or stainless steel, for example AISI 403, or AISI 422. Such substrate metals can be easily fabricated by forging to form rotating blades, pipes and impellers of power-generation, steam turbines.

Disposed integrally with the steel substrate 10, is preferably a boride layer 20, preferably including iron and chromium boride. In the preferred boride application process referred to as "pack cementation", the turbine component is placed in an air-tight, insulated container containing boron and an inert filler. The contents of the container are then heated to a temperature of at least about 1700° F., for about several hours, and then cooled to room temperature. During this pack cementation-diffusion process, a preferred iron-boride layer 20 is bonded metallurgically with the steel substrate 10 in a thickness of less than about 0.005 inches (0.125 mm). Also provided by this diffusion process is an inter-diffusion zone 15 which preferably comprises a lower concentration of boride within the substrate steel than in the layer 20. In the most preferred process, the boride layer 20 and the interdiffusion zone 15 represents a total thickness of about 0.001–0.005 inches (0.025–0.127 mm).

Figure 2:
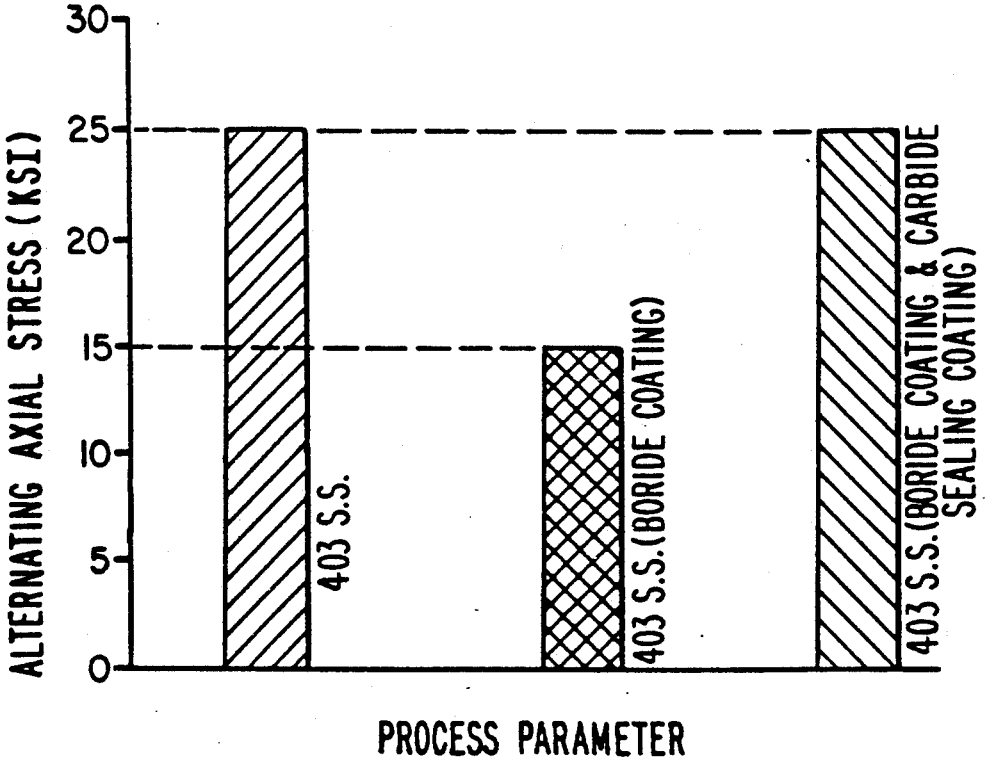
FIG 2: is a graph of alternating axial stress (ksi) for a 403 stainless steel substrate, a boride coated 403 stainless steel substrate, and boride-coated 403 stainless steel substrate having a subsequent sealing coating thereon.

Following the pack cementation process, the boride layered components are austenitized at elevated temperature, quenched and tempered, according to conventional heat treatment process parameters, to regain the steel substrate's original mechanical properties. During this subsequent heat treatment process, surface cracks 25 or other imperfections, are formed on the surface of the boride coating. Although the surface imperfections generally have a depth of less than about 0.001 inches 0.025 mm), they can extend through the boride layer 20 and into the inter-diffusion zone 15 or substrate steel 10 during service. These surface cracks 25 and imperfections have been demonstrated to reduce the surface erosion resistance of the boride coating and reduce the fatigue strength of the underlying substrate steel. Referring to FIG. 2, mechanical test data reveals that the alternating axial stress, a representation of fatigue strength, of a 403 stainless steel substrate was reduced by about 40% by the imperfections in the boride layer 20, but it is known that such boride coatings can decrease the fatigue strength from about 10% to about 58% of the uncoated substrate. See Qureshi and Tabakoff, supra., p.433. It has further been witnessed that such boride layers severely oxidize in steam at service temperatures of about 1100° F. (593° C.), and also produce spalling of the boride layer from the component surface.

Such inferior mechanical properties have been substantially overcome by a synergistic, two layer, duplex coating system, in which the first layer consists of a conventional hard boride layer 20, and a second, sealing layer 30, is provided over the boride layer 20. The sealing layer 30 preferably includes a hard coating material, e.g., above about $R_c35$, and more preferably above about R 40, such as chromium carbide, tungsten carbide, titanium carbide or a ceramic. Such layers can be provided to the boride layer 20 in thicknesses of less than about 0.001 inches (0.025 mm), preferably about 0.00025–0.0005 inches (0.0064–0.0127 mm). The sealing layers of this invention are preferably applied to the boride coatings with a low temperature metallurgical bonding process. Such processes typically transfer microparticles, molten droplets or melts of the hard coating material to the boride coated surface. The molten droplets become lodged in the boride coating surface, thereby sealing the surface cracks and imperfections. See FIG. 1. The sealing layer 30 preferably results in a hard glazed coating. Preferred low temperature processes suitable for applying the sealing layer 30 of this invention, include art-recognized electric spark deposition, physical vapor deposition, chemical vapor deposition, or laser application processes.

After the novel duplex coating is applied to the steam turbine component surfaces, the components are substantially free from surface cracks and imperfections. The resulting duplex coating includes a bottom erosion resistant boride coating and a top sealing coating which is resistant to both erosion and oxidation. The final steam turbine component not only has an erosion resistance of about twice that of the untreated boride coated surface, it also does not adversely effect the fatigue strength of the substrate steel.

Although various embodiments have been illustrated, this was for the purpose of describing, but not limiting the invention. Various modifications, which will become apparent to one skilled in the art, are within the scope of this invention described in the attached claims.

I claim:

1. A method of coating a turbine component to improve its surface erosion resistance, comprising:

(a) providing a turbine component having a ferrous substrate comprising a first surface thereon;

(b) providing a boride layer integral with said first surface;

(c) austentizing said boride layer; and (d) disposing a sealing layer onto said boride layer, said sealing layer being disposed by a low temperature bonding process.

2. The method of claim 1 wherein the low temperature bonding process is a process selected from the group consisting of electric spark deposition, physical vapor deposition, chemical vapor deposition, and laser application.

3. The method of claim 2 wherein the boride layer is provided by a pack cementation boride diffusion process.

4. The method of claim 2 wherein the sealing layer comprises chromium carbide, tungsten carbide, titanium carbide, ceramic, or a mixture thereof.

5. The method of claim 4 wherein the sealing layer comprises a thickness of about 0.0025–0.005 inches (0.0064–0.0127 mm).

6. The method of claim 4 wherein the sealing layer has a hardness of at least $R_c40$.

7. The method of claim 6 wherein the turbine component of step (a) is a steam turbine component.

8. The method of claim 1 wherein the low temperature bonding process is vapor deposition.

9. A method of coating a turbine component to improve its surface erosion resistance, comprising:

(a) providing a turbine component having a ferrous substrate comprising a first surface thereon;

(b) depositing, by means of a pack diffusion process, a boride layer integral with said first surface;

(c) austentizing said boride layer; and (d) disposing a sealing layer onto said boride layer, said sealing layer being disposed by a low temperature bonding process.

10. The method of claim 9 wherein the low temperature bonding process is a process selected from the group consisting of electric spark deposition, physical vapor deposition, chemical vapor deposition, and laser application.

11. The method of claim 10 wherein the sealing layer comprises chromium carbide, tungsten carbide, titanium carbide, ceramic, or a mixture thereof.

12. The method of claim 11 wherein the sealing layer comprises a thickness of about 0.0025–0.0005 inches (0.0064–0.0127 mm).

13. The method of claim 11 wherein the turbine component of step (a) is a steam turbine component.

14. The method of claim 9 wherein the low temperature bonding process is vapor deposition.

15. The method of claim 14 wherein the sealing layer comprises chromium carbide, tungsten carbide, titanium carbide, ceramic, or a mixture thereof.

16. The method of claim 15 wherein the sealing layer comprises a thickness of about 0.00025–0.0005 inches (0.0064–0.0127 mm).

17. The method of claim 16 wherein the turbine component of step (a) is a steam turbine component.

* * * * *